United States Patent [19]

Ehrlich

[11] 4,165,902

[45] Aug. 28, 1979

[54] KNOCKDOWN UPHOLSTERED FURNITURE

[76] Inventor: Richard A. Ehrlich, 11410 Washington Plaza West, Reston, Va. 22090

[21] Appl. No.: 866,254

[22] Filed: Jan. 3, 1978

[51] Int. Cl.[2] ..... A47C 7/00

[52] U.S. Cl. ..... 297/440

[58] Field of Search ..... 297/440, 443

[56] References Cited

U.S. PATENT DOCUMENTS

| | | | |
|---|---|---|---|
| 2,164,715 | 7/1939 | Krainbill | 297/440 X |
| 3,526,433 | 9/1970 | Miller | 297/440 |
| 3,669,495 | 6/1972 | Rudgisch | 297/443 X |
| 3,774,966 | 11/1973 | Faulkner | 297/440 |

FOREIGN PATENT DOCUMENTS

| | | | |
|---|---|---|---|
| 604989 | 7/1948 | United Kingdom | 297/443 |

*Primary Examiner*—James C. Mitchell
*Attorney, Agent, or Firm*—Robert H. Epstein

[57] ABSTRACT

Knockdown upholstered furniture has basic components coupled together by male and female connectors permitting simple assembly and disassembly to facilitate shipping and storage without requiring tools or hardware. Each male connector has hook-like lugs projecting outwardly from the connector with an inclined inner edge for wedging the lugs in place once they are inserted through openings in each female connector, and the connectors are surrounded with resiliently padded upholstery such that the connectors are recessed within the outer edges of the upholstery which resiliently forces the male and female connectors into secure engagement with each other. Preferably, the female connectors have an irregular surface adjacent the openings therein to engage irregular surfaces on the inner edges of the lugs of the male connectors.

18 Claims, 10 Drawing Figures

KNOCKDOWN UPHOLSTERED FURNITURE

BACKGROUND OF THE INVENTION

1. Field of the Invention

The present invention pertains to furniture and, more particularly, to knockdown upholstered furniture which can be easily assembled and disassembled.

2. Discussion of the Prior Art

There exists a great demand for knockdown furniture which can be easily assembled once it has been transported or shipped from a store or other location to an area in which the furniture is to be used and can be easily disassembled for further transportation or storage. The demand for such furniture is great because, ideally, such furniture can be packaged in containers of sufficiently small size to permit transportation in conventional automobiles of the sedan type and can be assembled and disassembled by persons with no particular mechanical skills or experience with the construction of furniture.

In the past, attempts to manufacture easily assembled and disassembled furniture, which is commonly referred to a "knockdown" furniture, have unfortunately had the disadvantages of requiring the manipulation of specially designed connectors, necessitating the use of conventional tools such as screwdrivers and wrenches and, many times, specially designed tools, and of requiring more than minimal mechanical skills. Another disadvantage of prior art knockdown furniture is that the connectors have a tendency to loosen during use and/or movement of the furniture thereby mandating constant surveillance and periodic adjustments to prevent collapse of the furniture. The problem of providing a connector for use with knockdown furniture which can be simply assembled and disassembled while producing a sturdy structure capable of withstanding everyday use has been one to which much attention has been directed, but this problem has not been solved by the prior art. To this end, prior art knockdown furniture connectors have not been of sufficient sturdiness to permit the construction of upholstered furniture designed to support human beings, such as sofas, chairs, love seats and the like, in that such furniture is subject to much movement, vibration and weight transfer during normal usage causing prior art connectors to disengage. U.S. Pat. Nos. 3,563,599 to Heumann, 3,774,966 to Faulkner et al and 3,857,120 to Acker are exemplary of prior art attempts to provide furniture of the knockdown type or having removable or detachable parts.

The use of lug-type connectors for fastening furniture components together is exemplified by U.S. Pat. Nos. 254,449 to Ayers, 603,162 to Baker, 881,673 to Ellison, 1,674,220 to Percival and 2,656,550 to Loeb; however, such lug-type connectors have not been used for upholstered furniture of the type which is necessarily heavy and sturdy to hold up under the weight of people sitting thereon and under the forces and vibrations created when such upholstered furniture is moved by pushing or pulling.

SUMMARY OF THE INVENTION

Accordingly, it is a primary object of the present invention to overcome the above mentioned disadvantages of the prior art by constructing knockdown upholstered furniture that can be simply and quickly assembled and disassembled while being of sturdy construction.

Another object of the present invention is to use a connector assembly formed of a male member having a series of aligned hook-like lugs and a female member having a series of aligned openings for receiving the lugs to connect components of upholstered furniture such that the furniture can be easily assembled and disassembled by a single person without requiring the use of tools whatsoever.

A further object of the present invention is to recess connectors for knockdown upholstered furniture within the outer edges of resilient padding of the upholstery such that the padding resiliently forces the connectors against each other to take up any looseness or slack between the connectors.

The present invention has an additional object in the use of male and female connectors to assemble knockdown upholstered furniture, the connectors having portions with rough or irregular surfaces contacting each other to prevent inadvertent disengagement of the connectors.

As yet another object, connectors for knockdown upholstered furniture according to the present invention are completely hidden from view after the furniture is assembled, the latter feature being made possible since access to the connectors by tools is not required for either assembly or disassembly of the furniture.

Yet a further object of the present invention is to design male and female connectors for use in assembling knockdown upholstered furniture with irregular surface areas in contact with each other to prevent inadvertent disengagement of the connectors. The female connector includes a plate having at least one opening therein with at least a portion of the back of the plate adjacent the opening having an irregular surface, such as a burr; and, the male connector includes at least one hook-like lug having a rounded tip leading into a curved inclined edge terminating at an irregular surface, such as a burr, the inclined surface providing a wedging action during engagement of the male and female connectors.

Some of the advantages of the present invention over the prior art are that the knockdown upholstered furniture of the present invention can be simply and quickly assembled and disassembled by a single person without tools, is extremely sturdy to withstand the rigors of normal use by heavy adults as well as frequent movement, and is aesthetically appealing with the connectors being completely hidden from view except when the furniture is disassembled.

The present invention is generally characterized in a knockdown upholstered furniture construction including first and second spaced arm assemblies, an upholstered back member extending between the first and second arm assemblies and having a portion forming a back support for persons sitting on the knockdown upholstered furniture construction, a front member extending between the first and second arm assemblies, a horizontal support extending between the first and second arm assemblies and the front member and the back member to provide seating support for persons sitting on the knockdown upholstered furniture construction, a plurality of first connectors carried on the first and second arm assemblies, a plurality of second connectors carried on opposite ends of the back member and the front member, the connectors of one of the first and second pluralities of connectors each being a female connector having an opening therein, and the connectors of the other of the first and second pluralities of connectors each being a male connector having a hook-like lug extending outwardly therefrom with the lug having an inner edge with an inclined portion for engaging the female connector after insertion of the lug in the opening in the female connector whereby the first and second arm assemblies are connected with the front and back members with a wedge-like action.

The present invention is further generally characterized in a knockdown upholstered furniture construction including a first member carrying a female connector formed of a plate having an opening therein, a second member carrying a male connector having a hook-like lug projecting therefrom with an inclined inner edge and adapted to be received in the opening in the female connector with a wedging action, and upholstery carried on the second member including resilient padding surrounding the male connector such that the male connector is recessed within an outer edge of the padding, the padding engaging the first member when the male connector is coupled with the female connector to resiliently force the male and female connectors into secure engagement with each other.

Other objects and advantages of the present invention will become apparent from the following description of the preferred embodiment taken in conjunction with the accompanying drawings.

DESCRIPTION OF THE PREFERRED EMBODIMENT

Figure 1:
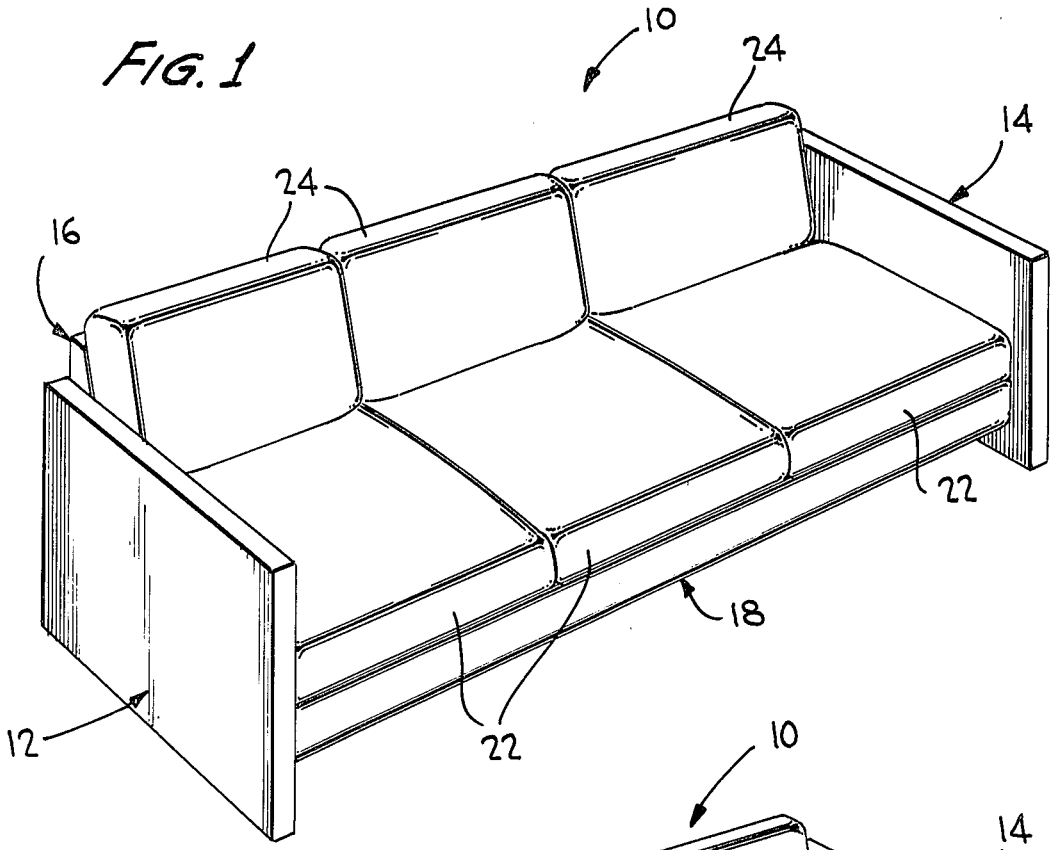
FIG. 1 is a perspective view of a knockdown upholstered furniture construction according to the present invention.
Figure 2:
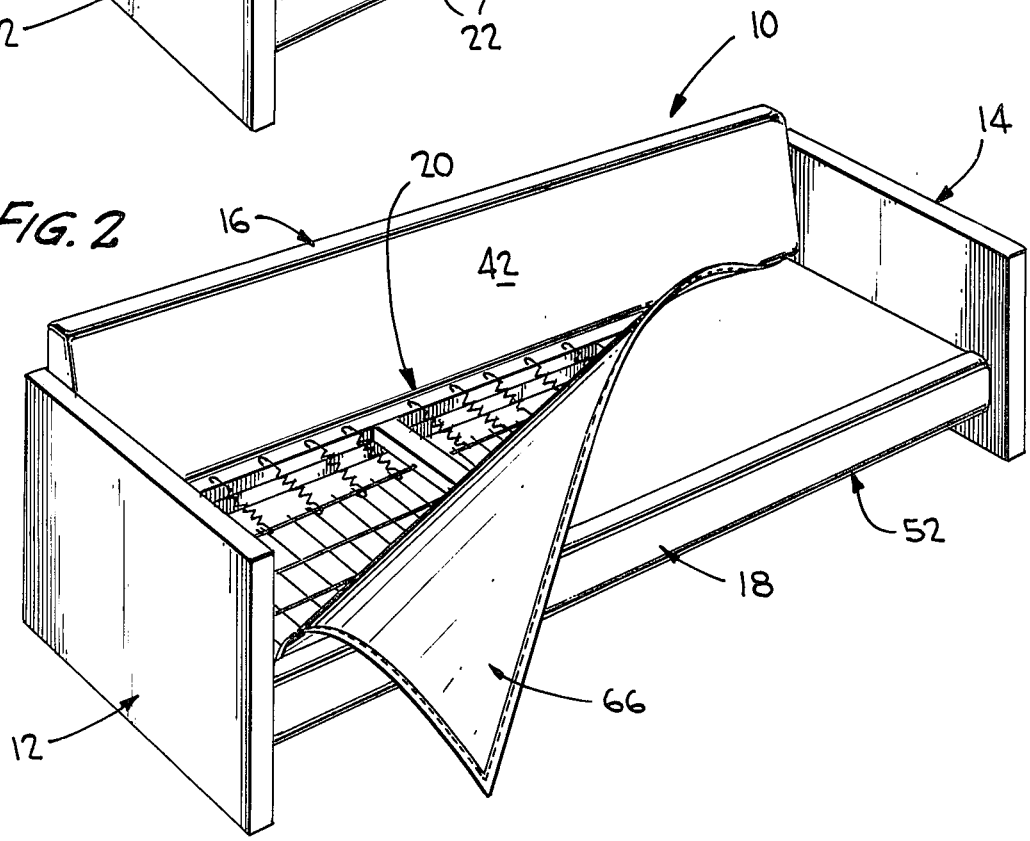
FIG. 2 is a perspective view of the knockdown upholstered furniture construction of FIG. 1 with the cushions removed and the spring deck cover partially pulled away.
Figure 3:
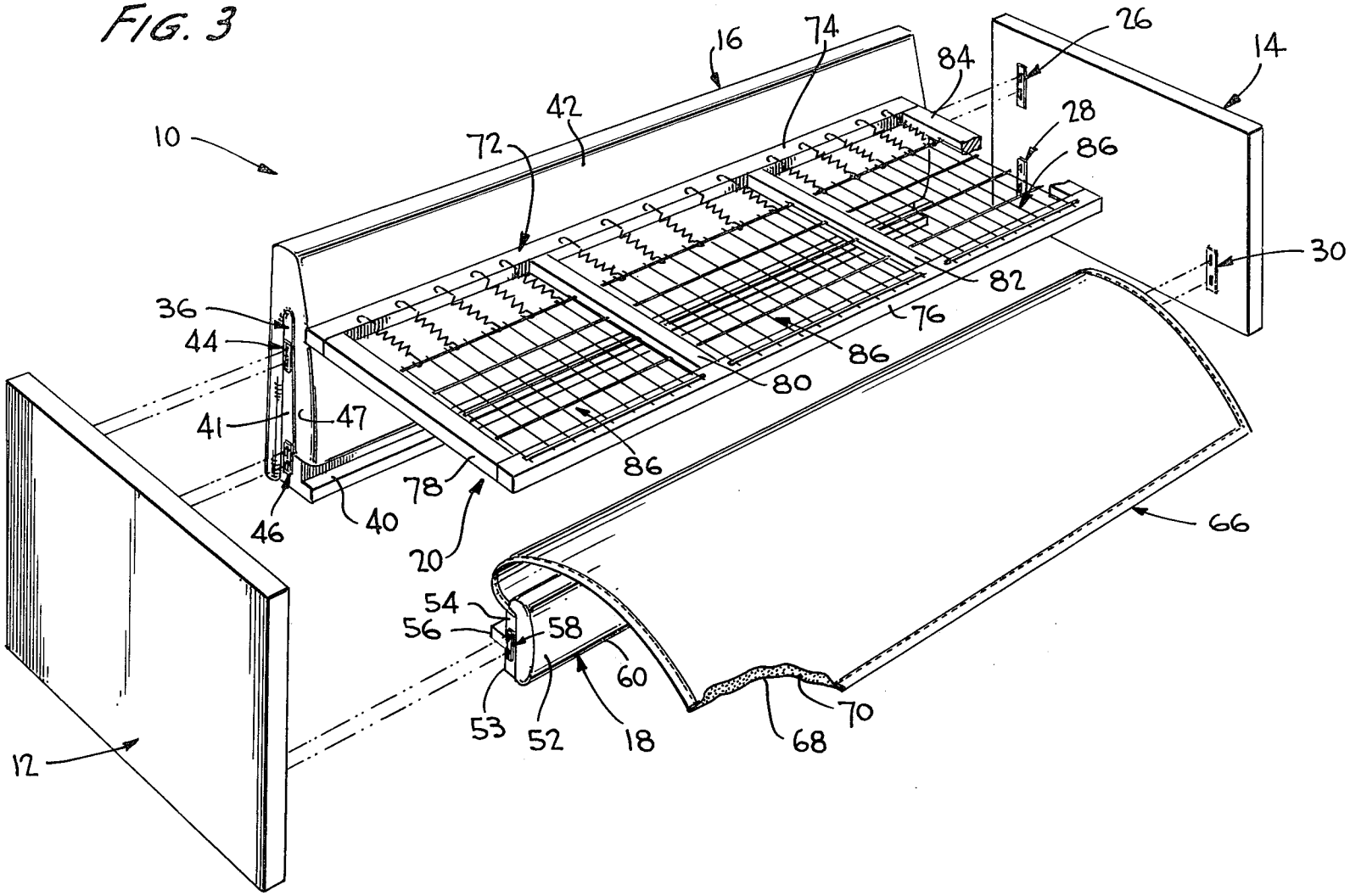
FIG. 3 is an exploded perspective view of the knockdown upholstered furniture construction of FIG. 1 without cushions.
Figure 4:
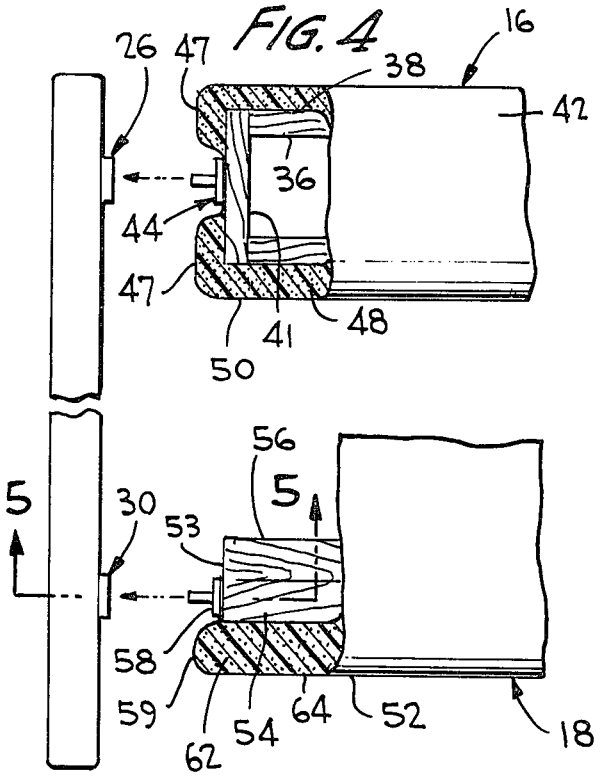
FIG. 4 is a broken top view partly in section showing the assembly of an arm assembly with front and back members of the knockdown upholstered furniture construction of FIG. 1.

A knockdown upholstered furniture construction 10 according to the present invention is shown in FIGS. 1, 2 and 3 in the form of a sofa having, as basic components, arm assemblies 12 and 14, a back member 16, a front member 18, a spring deck 20, seat cushions 22 and back rest cushions 24.

Figure 5:
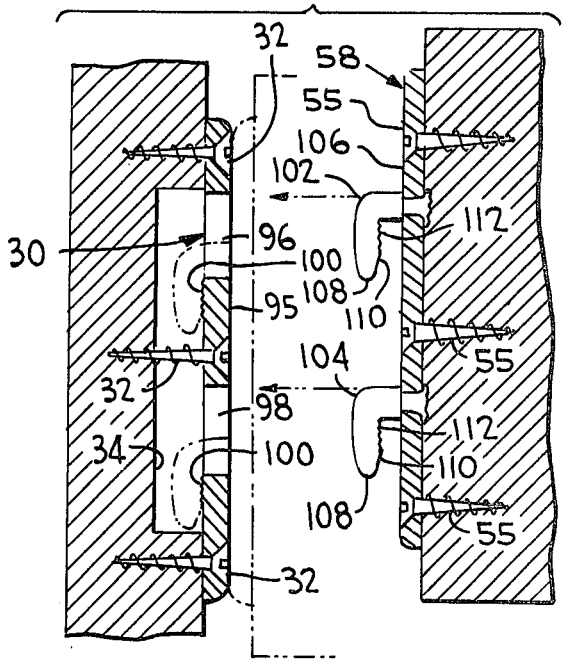
FIG. 5 is a section taken along line 5—5 of FIG. 4.

The arm assemblies 12 and 14 are illustrated as being formed of a solid block of material, such as wood, commonly referred to as a "butcher block" configuration, with the upper edges of the arm assemblies forming arm rests at the ends of the sofa. A pair of female connectors 26 and 28 are carried on the inner walls of each of arm assemblies 12 and 14 adjacent the back vertical edge thereof in vertically spaced relation, and a female connector 30 is carried near the front edge of each arm assembly in horizontal alignment with connector 28. As best shown in FIG. 5, each of the female connectors 26, 28 and 30 is mounted on the arm assemblies by means of screws 32, and a recess 34 is formed in the arm assemblies behind each connector to accommodate a male connector, as will be described in more detail hereinafter.

The back member 16 includes a wood frame 36 forming an upstanding support 38 and a ledge 40 providing a support for the spring deck 20. The upstanding support 38 has end walls 41 and is upholstered at 42 to define a back support for persons sitting on the sofa, the back support having any desirable configuration for seating and aesthetic purposes. A pair of vertically spaced male connectors 44 and 46 are mounted on each of the end walls 41 of the upstanding support 38 by means of screws (not shown) with the upholstery 42 surrounding the connectors such that the connectors are recessed below the outer edges of the upholstery. The upholstery 42 is formed of a resilient padding 48, such as a foam material, covered by a woven fabric 50 chosen in accordance with aesthetic appeal.

The front member 18 is composed of a rail 52 formed by a wood member 53 of generally L-shaped configuration to define an upright portion 54 and a horizontal portion 56 forming a ledge aligned with the ledge 40 of the back member 16 to support the spring deck 20. A male connector 58 is mounted on each end of the upright portion 54 by means of screws 55; and, similar to the back member, the connector 58 is recessed within the outer edges 59 of upholstery 60 covering the wood member 53. The upholstery 60 includes a resilient padding 62, such as a foam material, covered by a woven fabric 64 shaped to provide a tear drop external configuration for the rail 52, and a flap 66 extends from the upper edge of the rail to be disposed over the spring deck 20. The flap 66 is integrally formed as one piece with the rail 52 and contains a resilient padding 68, such as a polyurethane foam section, and a woven polypropylene material 70 extending over the padding 68 to resist tearing by the springs in the spring deck 20 and to produce a low friction coefficient to slide on the springs and allow unimpaired spring action. The flap 66 and the rail 52 are sewn from a single piece of fabric 64 with the fabric being folded over the edges of the flap and stitched thereto, and the tear drop configuration of the rail 52 provides an upraised front edge preventing seating cushions 22 from sliding off of the sofa.

Figure 6:
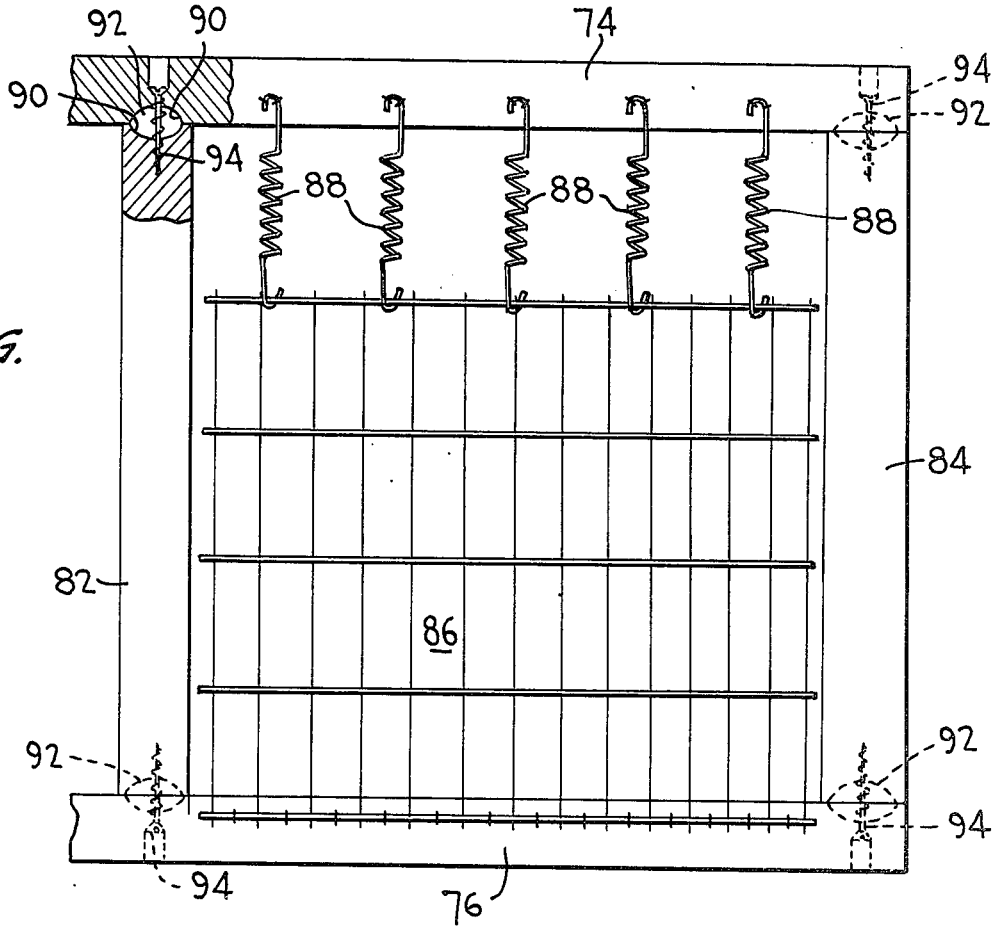
FIG. 6 is a broken view of the spring deck of the knockdown upholstered furniture construction of FIG. 1.
Figure 7:
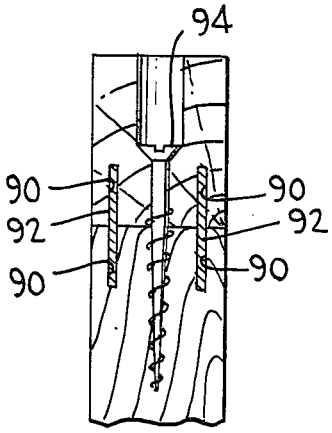
FIG. 7 is a section showing a wood joint of the spring deck.
Figure 8:
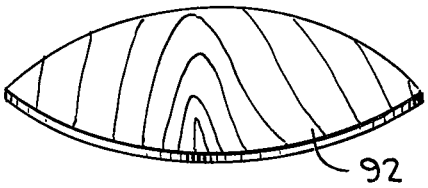
FIG. 8 is a perspective view of an oval spline used in the wood joint of FIG. 6.

The spring deck 20 is formed of a wood frame 72 composed of end members 74 and 76 and cross members 78, 80, 82 and 84. The spaces between the cross members from windows within which are disposed spring assemblies composed of plastic coated wire networks 86 secured to end member 76 and a plurality of coiled springs 88 having hooked ends secured to an end of the network 86 and to the end member 74, as best shown in FIG. 6. The cross members are connected with the end members by means of a splined wood joint in order to impart great strength to the spring deck, the wood joints being formed by aligned grooves 90 formed in the edges of the end and cross members with spaced oval splines 92 inserted therein to prevent either bending or rotational relative movement between the end and cross members. To further strengthen the joints, screws 94 extend through the end and cross members between the splines 92. The spring deck 20 is configured to be supported on the ledges 40 and 56 of the back member and the front member bounded at the ends by the arm assemblies 12 and 14.

Figure 9:
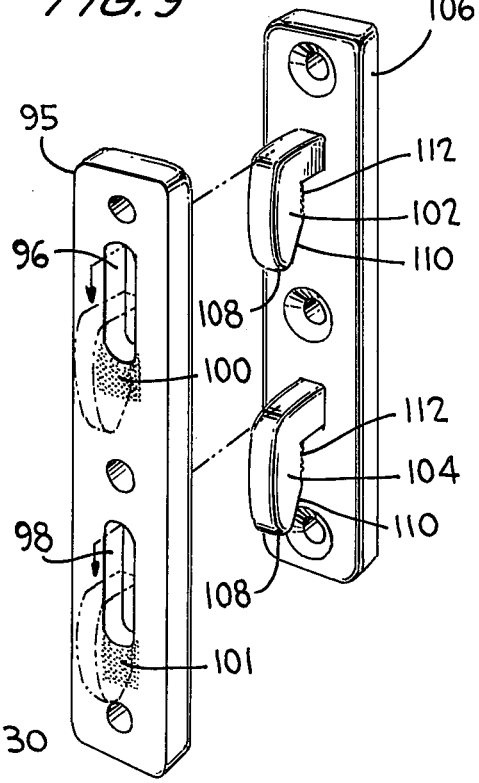
FIG. 9 is a perspective view of male and female connectors used with the knockdown upholstered furniture construction of FIG. 1.

The structure of the male and female connectors is best shown in FIGS. 5 and 9 wherein it can be seen that each of the female connectors is formed of a plate 95 having spaced openings 96 and 98 therein with irregular surfaces 100, such as burrs or roughened areas, formed on the back of the plate adjacent the lower edge of each opening. If desired, the entire back surface of the plate 95 can be irregular, it being important only that at least the areas under the openings be irregular. The male connectors each carry spaced hook-like lugs 102 and 104 projecting from the front of a plate 10 and each having a rounded tip 108 leading to a curved inclined edge 110 which terminates at a linear irregular surface 112, such as a burr or a roughened area. The irregular surface 112 is arranged in substantially parallel relation with the front face of the plate 106 to form a recess for receiving the portion of the plate 105 below each opening in the female connectors with the irregular surfaces 100 and 112 in contact with each other to provide a secure engagement of the male and female connectors, as shown in dashed lines in FIGS. 5 and 9. To couple the male and female connectors, the lugs 102 and 104 are aligned with the openings 96 and 98, respectively, and inserted therethrough; and, thereafter, the lugs are forced downwardly with the curved inclined edges 110 wedging the lugs in position and the irregular surfaces 100 and 112 contacting each other. The male and female connectors are constructed of punched and swaged metal so as to provide an extremely strong and strudy connection.

In assembling the sofa 10, the back member 16 is disposed adjacent the arm assembly 12 and the male connectors 44 and 46 are positioned adjacent the female connectors 26 and 28, respectively, the back member then being forced laterally against the arm assembly to compress resilient padding 48 of the upholstery to permit the lugs 102 and 104 of the male connectors to be received in the openings 96 and 98 of the female connectors and, then, forced downwardly to position the lugs relative to the openings such that the irregular surfaces 100 and 112 are in engagement. The male connector 58 on the end of the front member 18 is now coupled with the female connector 30 carried by arm assembly 12 in the same manner as mentioned above; and, once the ends of the front and rear members are connected with arm assembly 12, the opposite ends are similarly connected with arm assembly 14. With both arm assemblies 12 and 14 and back and front members 16 and 18 connected, the spring deck 20 is positioned on ledges 40 and 56 to form a horizontal support for people sitting on the sofa 10. The spring deck 20 is positioned with coiled springs 88 adjacent the back member 16 such that a person seated on the sofa will tend to slide back rather than forward on the sofa. After the spring deck is in place, the cover flap 66 is positioned over the spring deck, and the seating cushions 22 and the back rest cushions 24 are set in place.

The sofa 10 can be simply disassembled by applying a force or tapping the back and front members in a direction to move the lugs of the male connectors upward to permit their removal through the openings in the female connectors. It is noted, however, that such movement of the lugs to disengage the connectors will not occur during normal use of the sofa due to the wedging action and the secure engagement provided by the contact of the irregular surfaces on the male and female connectors.

Figure 10:
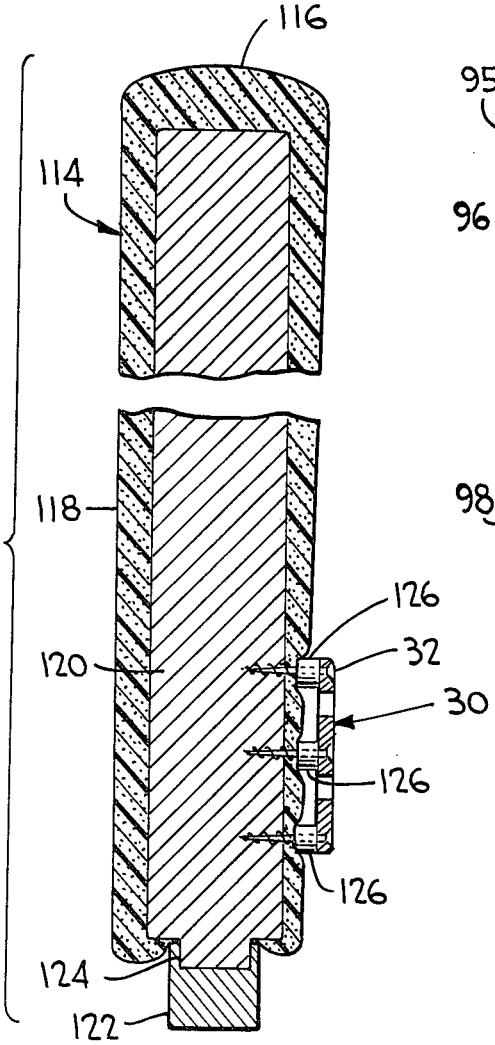
FIG. 10 is a section of a modification of the knockdown upholstered furniture construction according to the present invention having upholstered arms.

A modification of the present invention is illustrated in FIG. 10 wherein the arm assemblies of the sofa are covered with upholstery 114 formed of a fabric 116 covering a resilient foam padding 118. The arm assembly is formed of a wooden frame 120 having a runner 122 secured in any suitable manner to a key 124 along the bottom of the frame. The female connector 30 is secured to the arm assembly by means of screws 32 passing through the upholstery 114 to engage the frame 120 and the female connector 30 is spaced from the upholstery by means of ferrules 126 through which the screws 32 extend in order to accommodate the hook-like lugs of the male connectors 58 carried on the ends of the front member 18. If desired, ferrules or other spacers could be utilized with the solid block arm assemblies of the sofa of FIG. 1 thereby eliminating the necessity of forming a recess 34, as shown in FIG. 5, in the arm assembly.

The assembly of a knockdown upholstered furniture construction utilizing the arm assembly of FIG. 10 is similar to that described above with the exception that the upholstery surrounding the male connectors on the ends of the back member 16 and the front member 18 and the upholstery 114 on the arm assemblies are both slightly compressed during coupling of the male and female connectors to resiliently force the male and female connectors into secure engagement with each other.

The male and female connectors utilized with the present invention are quite strong and provide an extremely stable connection for the knockdown upholstered furniture construction, such connection being prevented from inadvertent disengagement by the contacting of the irregular surfaces and being simple to assemble by means of the wedging action provided by the curved inclined inner edge. Preferably, all edges of the connectors are rounded to prevent tearing of upholstery during assembly or disassembly of the knockdown upholstered furniture construction.

Inasmuch as the present invention is subject to many variations, modifications and changes in detail, it is intended that all matter described above or shown in the accompanying drawings be interpreted as illustrative and not in a limiting sense.

What is claimed is:

1. A knockdown upholstered furniture construction comprising first and second spaced arm assemblies;

an upholstered back member extending between said first and second arm assemblies and having a portion forming a back support for persons sitting on said knockdown upholstered furniture construction;

a front member extending between said first and second arm assemblies;

horizontal support means extending between said first and second arm assemblies and said front member and said back member to provide seating support for persons sitting on said knockdown upholstered furinture construction;

a plurality of first connector means carried on said first and second arm assemblies;

a plurality of second connector means carried on opposite ends of said back member and said front member;

said connector means of one of said first and second pluralities of connector means each being a female connector having an opening therein; and said connector means of the other of said first and second pluralities of connector means each being a male connector having a hook-like lug extending outwardly therefrom with said lug having an inner edge with an inclined portion for engaging said female connector after insertion of said lug in said opening in said female connector to connect said first and second arm assemblies with said front and back members with a wedge-like action, said upholstery on said back member including a resilient padding surrounding said plurality of second connector means carried by said back member such that said second connector means carried by said back member are recessed within said resilient padding, the outer edges of said resilient padding engaging said first and second arm assemblies and being compressed to resiliently force said male and female connectors into secure engagement with each other.

2. A knockdown upholstered furniture construction as recited in claim 1 wherein each of said female connectors has an irregular surface adjacent said opening therein and each of said male connectors has an irregular surface on said inner edge, said irregular surfaces of said male and female connectors engaging each other to provide a secure coupling of said male and female connectors.

3. A knockdown upholstered furniture construction as recited in claim 1 wherein said male connectors are carried by said back member and said front member, and said female connectors are carried by said arm assemblies.

4. A knockdown upholstered furniture construction as recited in claim 3 wherein said back member has opposite ends with first and second vertically spaced male connectors carried on each of said opposite ends, and said first and second arm assemblies each carries first and second vertically spaced female connectors for receiving said first and second male connectors.

5. A knockdown upholstered furniture construction as recited in claim 4 wherein said front member carries a single male connector on each end thereof and said front member is upholstered including a resilient padding surrounding said male connectors such that said male connectors are recessed within the outer edges of said resilient padding, said resilient padding engaging said first and second leg assemblies and being compressed to resiliently force said male and female connectors into secure engagement with each other.

6. A knockdown upholstered furniture construction as recited in claim 5 wherein said horizontal support means includes a spring deck and said front member includes a cover flap formed integrally therewith and extending over said spring deck to permit sliding movement thereon.

7. A knockdown upholstered furniture construction as recited in claim 6 wherein said cover flap of said front member is formed of a polyurethane foam skin padding covered by a woven polypropylene material for engaging said spring deck.

8. A knockdown upholstered furniture construction as recited in claim 7 wherein said spring deck is formed of a wooden frame including end members and cross members, said cross members and said end members having aligned grooves therein receiving oval wood splines to form a joint with screw means extending through said joint between said splines.

9. A knockdown upholstered furniture construction as recited in claim 5 wherein each of said female connectors has an irregular surface adjacent said opening therein and each of said male connectors has an irregular surface along said inner edge, said irregular surfaces of said male and female connectors engaging each other to provide a secure coupling of said male and female connectors.

10. A knockdown upholstered furniture construction as recited in claim 1 wherein each of said female connectors has a series of vertically spaced openings therein and each of said male connectors has a series of vertically spaced hook-like lugs removably inserted in said openings.

11. A knockdown upholstered furniture construction as recited in claim 10 wherein each of said hook-like lugs of said male connectors has a rounded tip leading into a curved inclined inner edge terminating at a linear irregular surface.

12. A knockdown upholstered furniture construction as recited in claim 5 wherein said first and second arm assemblies are upholstered with resilient padding surrounding said female connectors, the outer edges of said resilient padding of said first and second arm assemblies and said back and front members engaging one another to compress said resilient paddings and resiliently force said male and female connectors into secure engagement with each other.

13. A knockdown upholstered furniture construction as recited in claim 12 wherein said female connectors are mounted in said arm assemblies by screws and are spaced from said upholstery on said arm assemblies by ferrules on said screws to provide space for accommodating said lugs of said male connectors.

14. A knockdown upholstered furniture construction as recited in claim 5 wherein said arm assemblies are constructed of wood and have recesses aligned with said female connectors for accommodating said lugs of said male connectors.

15. A knockdown upholstered furniture construction comprising a first member carrying a female connector formed of a plate having an opening therein;

a second member carrying a male connector having a hook-like lug projecting therefrom with an inclined inner edge and adapted to be received in said opening in said female connector with a wedging action; and upholstery carried on said second member including resilient padding surrounding said male connector such that said male connector is recessed within an outer edge of said padding, said padding engaging said first member when said male connector is coupled with said female connector to be compressed and resiliently force said male and female connectors into secure engagement with each other.

16. A knockdown upholstered furniture construction as recited in claim 15 wherein an irregular surface is formed on the back of said plate of said female connector adjacent said opening, and an irregular surface is formed on said inner edge of said lug of said male connector to engage said irregular surface on said female connector when said male and female connectors are coupled together.

17. A knockdown upholstered furniture construction as recited in claim 16 wherein said female connector includes a spaced series of said openings and said male connector including a spaced series of said hook-like lugs.

18. A knockdown upholstered furniture construction as recited in claim 11 wherein each of said female connectors has an irregular surface adjacent each of said openings to engage said linear irregular surface on each of said hook-like lugs of said male connectors to provide secure coupling of said male and female connectors.

* * * * *